US005921748A

United States Patent [19]

Frater

[11] Patent Number: 5,921,748

[45] Date of Patent: Jul. 13, 1999

[54] CENTRIFUGAL PUMP

[75] Inventor: John Semple Frater, Scotsdale, Ariz.

[73] Assignee: Sykes Pumps Australia Pty Ltd, Cardiff, Australia

[21] Appl. No.: 08/894,817

[22] PCT Filed: Feb. 23, 1996

[86] PCT No.: PCT/AU96/00101

§ 371 Date: Nov. 26, 1997

§ 102(e) Date: Nov. 26, 1997

[87] PCT Pub. No.: WO96/27085

PCT Pub. Date: Sep. 6, 1996

[30] Foreign Application Priority Data

Mar. 1, 1995 [AU] Australia ..... PN1437

[51] Int. Cl.[6] ..... F01D 5/00

[52] U.S. Cl. ..... 415/172.1; 415/171.1; 415/173.2; 415/174.1; 415/174.3; 415/173.3; 415/191; 415/196; 415/128

[58] Field of Search ..... 415/172.1, 171.1, 415/173.2, 174.1, 174.3, 173.3, 191, 196, 128

[56] References Cited

U.S. PATENT DOCUMENTS

| | | | |
|---|---|---|---|
| 4,208,166 | 6/1980 | Schroeder et al. | 415/172.1 |
| 4,527,948 | 7/1985 | Addie | 415/128 |
| 4,664,592 | 5/1987 | Grzina | 415/171.1 |
| 4,854,820 | 8/1989 | Zolotar et al. | 415/171.1 |
| 5,209,635 | 5/1993 | Stewart et al. | 415/171.1 |

*Primary Examiner*—Christopher Verdier
*Assistant Examiner*—Ninh Nguyen
*Attorney, Agent, or Firm*—Townsend and Townsend and Crew LLP

[57] ABSTRACT

A centrifugal pump comprises an impeller (2*a* and 2*b*) which is rotatable about an axis (X—X) inside a static volute (1). The pump is further provided with a sealing arrangement (11). The sealing arrangement (11) reduces or substantially eliminates the clearance between the surface of the suction side of the impeller (2*a*) and the static volute (1). The sealing arrangement is axially adjustable.

12 Claims, 8 Drawing Sheets

CENTRIFUGAL PUMP

This application was filed under 35 U.S.C. 371 based upon PCT application AU96/00101, filed on Feb. 23, 1996, which claims priority of Australian patent PN 1437 filed on Mar. 1, 1995.

FIELD OF THE INVENTION

The present invention relates to centrifugal pumps and, in particular, to a centrifugal pump suitable for pumping mixtures of liquids and abrasive solids.

BACKGROUND OF THE INVENTION

Centrifugal pumps are commonly used to pump mixtures of liquids and solids, such as slurry in mineral processing. Particularly in mining, the solid particles of ore in the slurry are highly abrasive. These particles can become trapped between the rotating impeller and the static volute (pump casing) during use, causing wear and abrasion of both the impeller and the volute. This wear reduces the life of the pump and its hydraulic efficiency and leads to greater down-time for repairs.

Conventional centrifugal slurry pumps provide vanes on the gland side of the impeller which reduce the hydraulic pressure at the impeller shaft in order to assist the gland sealing mechanism where the shaft enters the volute. There is normally a small clearance between the vanes and the static volute of the pump. Vanes are also conventionally provided on the suction side of the impeller to discourage slurry from recirculating back into the low pressure suction zone of the pump from the high pressure discharge chamber.

One of the disadvantages of the slurry pumps described above is that the areas between the vanes on the suction side and the gland side of the impeller provide an opening between the impeller and static volute at the periphery of the impeller. Abrasive solid particles from the slurry can enter these spaces and become trapped between the vanes of the impeller and the static volute, causing wear to both the impeller and the volute.

This problem is more prevalent and critical on the suction side of the impeller, where the high pressure liquid inside the discharge portion of the volute tends to flow (through the clearance between the impeller and the static volute) towards the low pressure zone in the suction portion of the pump. Wear on the suction side of the impeller is particularly undesirable, as it causes an increased amount of slurry to recirculate, resulting in a loss of pump hydraulic performance and efficiency. As there is no flow through the gland, wear on the gland side of the impeller is less significant, but still undesirable.

In an attempt to overcome this problem, the casings of some prior art centrifugal pumps (see FIG. 1) are provided with an angled face (3) adjacent to the intake throat (8) of the pump. The angled face (3) of the pump casing is closely aligned with a similar angled face (4) on the suction side of the impeller (2*a*). Provided a small enough clearance (c) can be achieved between the two angled faces (3,4), a degree of sealing can be achieved between the impeller (2*a*) and the casing (1).

However, because the faces (3,4) are inclined at an angle to the axis (X—X) of other than 90°, the faces (3,4) must be exactly concentric with respect to each other and the axis (X—X) in order to achieve the desired sealing. Any eccentricity on the part of either the impeller angled face (4) or the casing angled face (3) will impair the seal and allow slurry to recirculate back to the intake (8), causing wear and loss of pump efficiency.

Further, to adjust the size of the clearance (c) between the two faces (3,4), the pump must be shut down and the entire impeller (2*a*,2*b*) moved towards or away from the casing (1). This is time consuming and expensive. Also, any wear which may occur will be directly on the impeller (2*a*) or the casing (1), which are both large and expensive parts to replace.

OBJECT OF THE INVENTION

It is an object of the present invention to overcome or substantially ameliorate the above disadvantages.

SUMMARY OF THE INVENTION

There is disclosed herein a centrifugal pump comprising:

an impeller rotatable about an axis, said impeller having a suction side and a gland side;

a plurality of raised vanes on the suction side of said impeller, wherein the clearance between said vanes and said static volute is greater than the predicted size of the largest solid particle in a normal design particle size distribution of said solid/liquid mixture; and a static volute, said impeller being adapted to rotate inside said static volute;

axially adjustable sealing means adapted to reduce or substantially eliminate the clearance between the rim at the eye of said impeller and the extended inlet spout of said static volute.

BRIEF DESCRIPTION OF THE DRAWINGS

Several embodiments of the present invention will now be described, by way of example only, with reference to the accompanying drawings, wherein.

DETAILED DESCRIPTION

Figure 1:
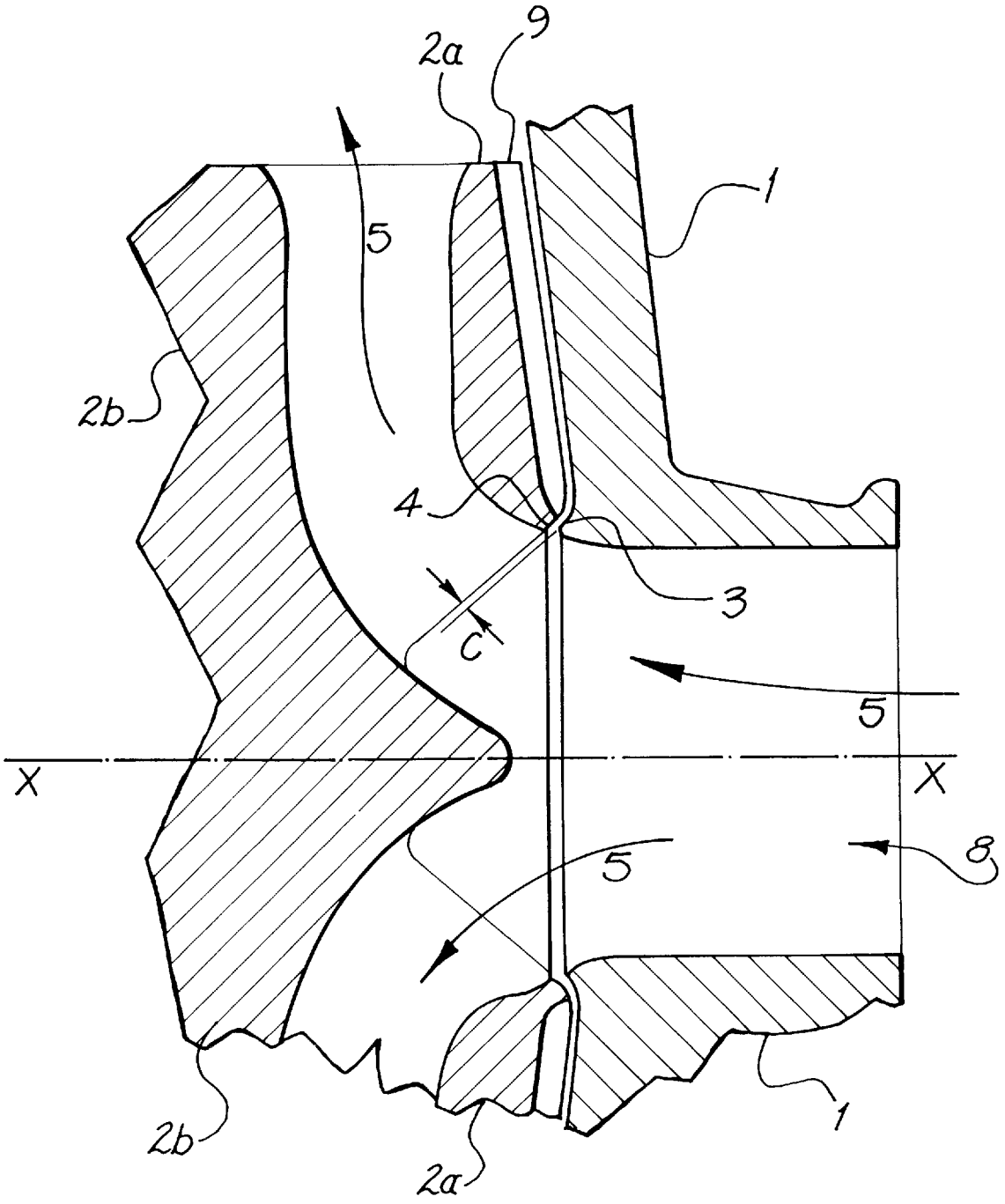
FIG. 1 PRIOR ART
FIG. 1 is a partial cross-section of a prior art centrifugal pump.
Figure 2:
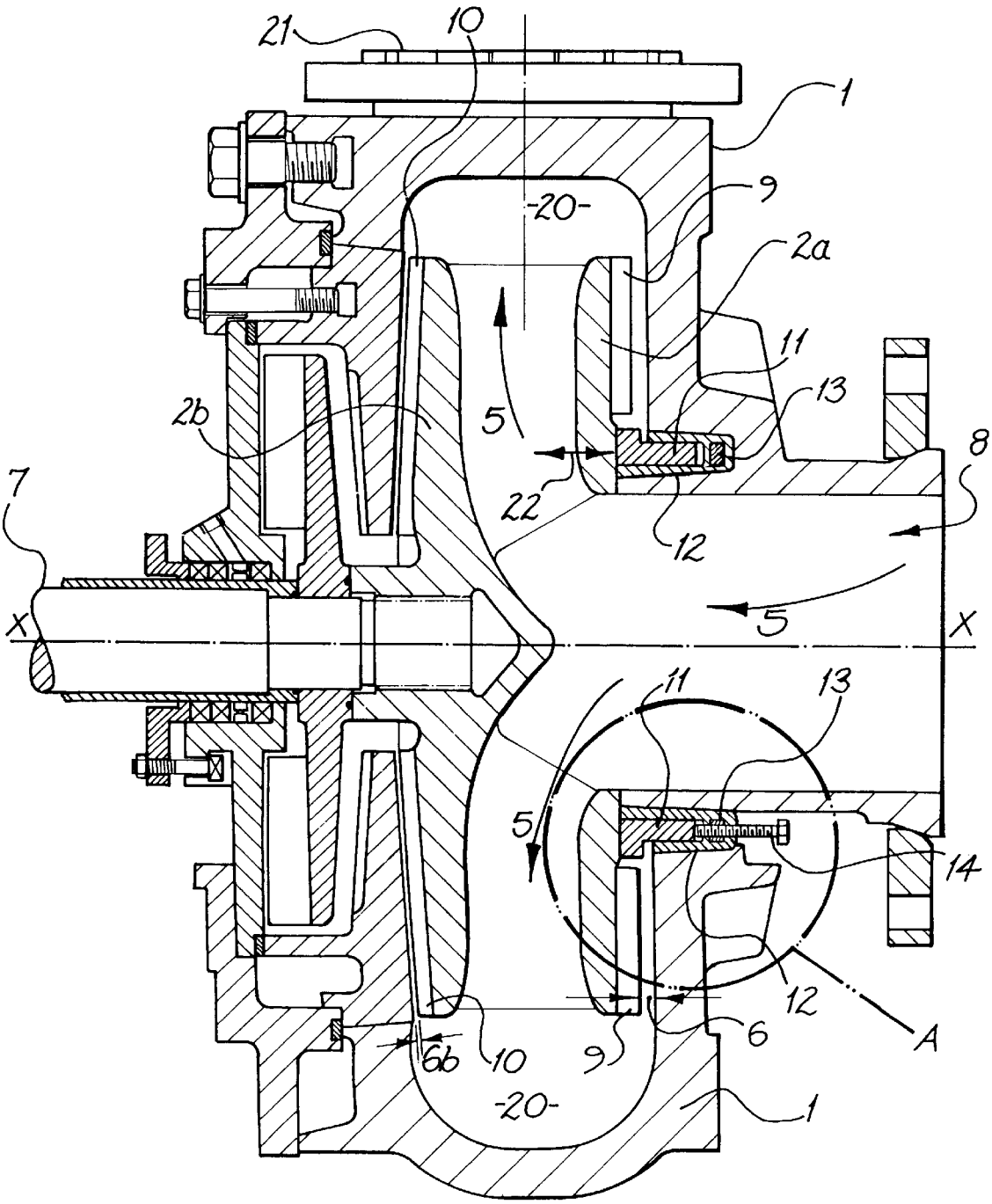
FIG. 2 is a cross-section of a preferred embodiment of a centrifugal pump.

Referring to FIG. 2, the centrifugal pump comprises a shaft (7), an impeller (2*a* and 2*b*), and a static volute (1). The impeller comprises a suction side (2*a*) and a gland side (2*b*). The impeller (2*a* and 2*b*) is driven by a motor (not shown) via the shaft (7) and rotates about the axis (X—X) inside the static volute (1). In the examples described herein, the static volute is comprised of the pump casing (1). The slurry or substance to be pumped enters the pump via the intake throat (8) and is forced at high pressure through the rotating impeller (see arrows 5) into the high pressure region (20) inside the pump casing (1), from where it is discharged via the discharge pipe (21).

Figure 6:
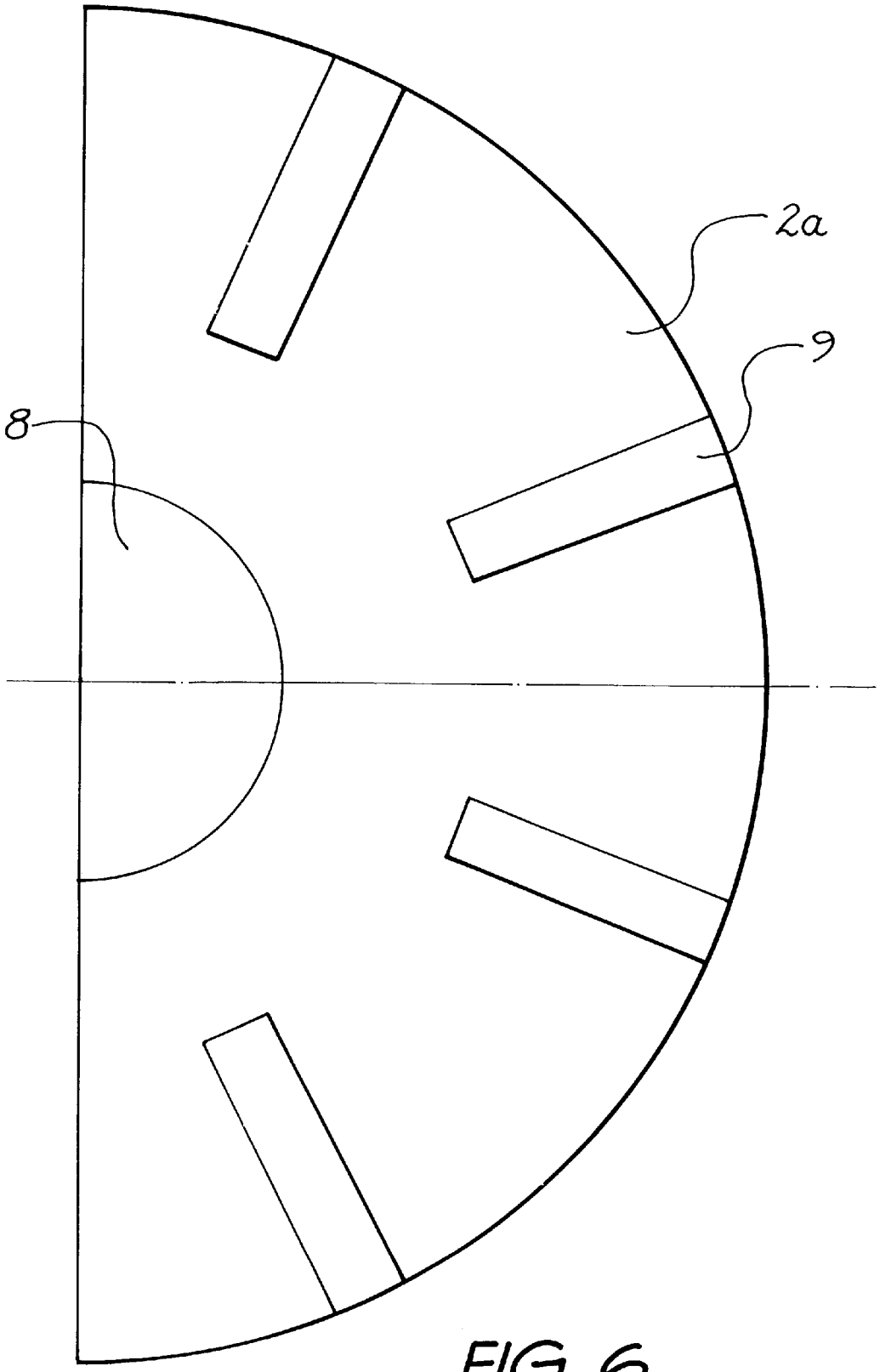
FIG. 6 is a partial plan view of the suction side of an impeller.

The suction side of the impeller (2*a*) is preferably provided with a plurality of radially arranged vanes (9), which can be seen in plan view in FIG. 6.

The clearance (6) between the vanes (9) and the pump casing (1) is preferably greater than the predicted size of the largest solid particle in the normal design distribution of the slurry to be pumped. This is to prevent abrasive solids from becoming trapped between the rotating impeller vanes (9) and the pump casing (1).

When the pump is running, the vanes (9) reduce the hydraulic pressure in the region between the impeller suction side (2*a*) and the casing (1) to help prevent slurry from flowing into the clearance (6) between the impeller (2*a*) and the casing (1). The vanes (9) should not be long enough to interfere with the wear ring (11), the function of which is described below.

Figure 7:
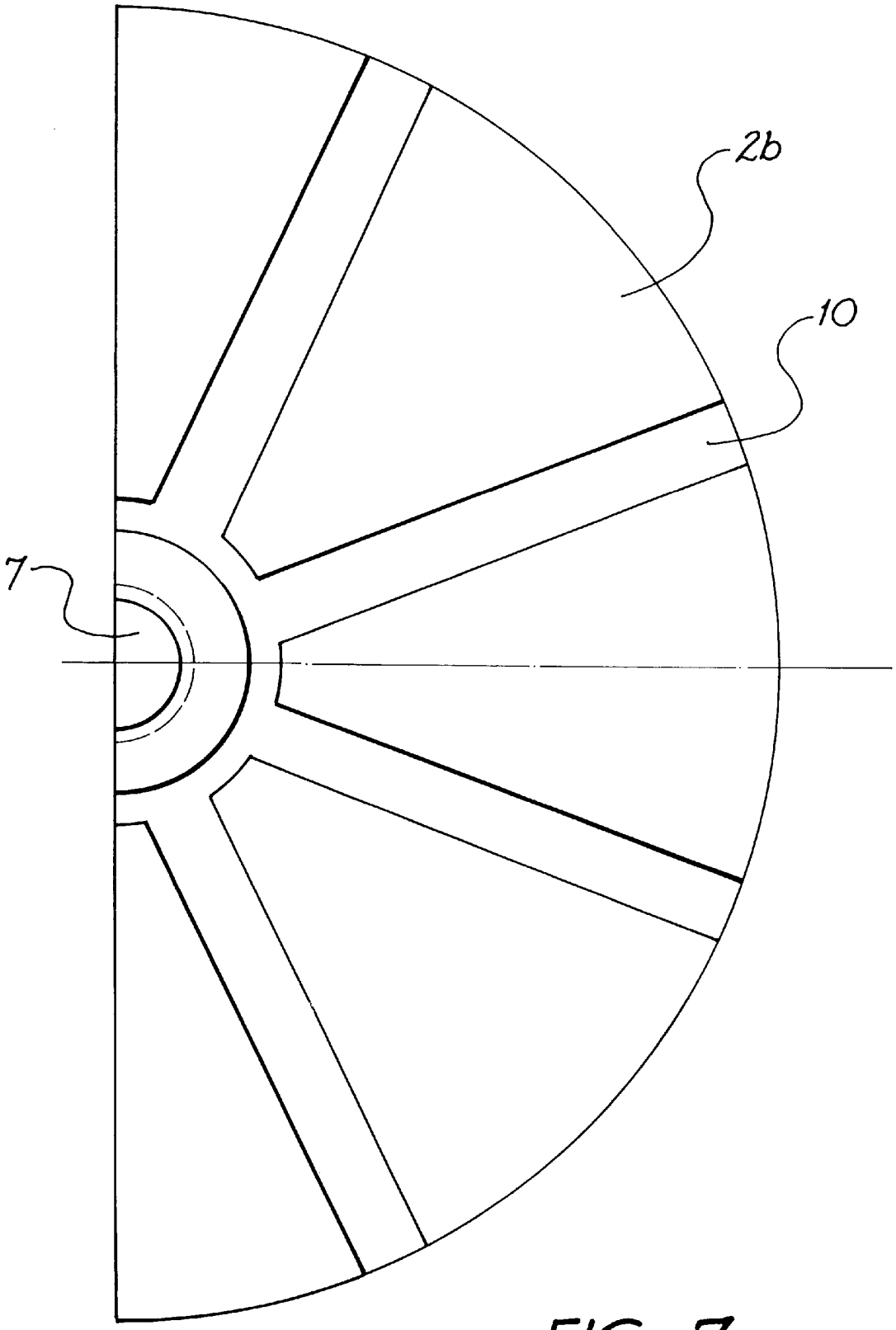
FIG. 7 is a partial plan view of the gland side of an impeller.

It is preferred that the gland side of the impeller (2*b*) is provided with a plurality of radially disposed channels (10) formed in the surface of the impeller (2*b*), rather than vanes. The channels (10) can be seen in plan view in FIG. 7. Providing channels (10) rather than vanes on the gland side (2*b*) of the impeller means that the open area between the vanes allowing ingress of solids between the impeller (2*b*) and the casing (1) can be greatly reduced. This results in a reduction in the entry of solids into the gland side running clearance (6*b*). The channels (10) expel material which may enter the clearance (6*b*) between the impeller (2*b*) and the casing (1).

A substantially annular wear ring (11) is provided in a recess in the pump casing (1). The wear ring (11) is preferably L-shaped cross-section In use the wear ring (11) is axially adjusted so as to be closely adjacent to the surface of the impeller (2*a*) suction side. In use, the wear ring (11) effectively seals the space between the impeller (2*a*) and the pump casing (1) further reducing the flow of slurry from the high pressure region (20) back into the low pressure intake (8). Therefore, abrasive particles are less likely to become trapped between the impeller (2*a*) and the casing (1).

The wear ring (11) is preferably housed in the wear ring carrier (12). The wear ring carrier (12) seals the pump casing (1) against leakage of liquids or slurry to the atmosphere. The wear ring carrier (12) is preferably made of a resilient material such as polyurethane.

Figure 3:
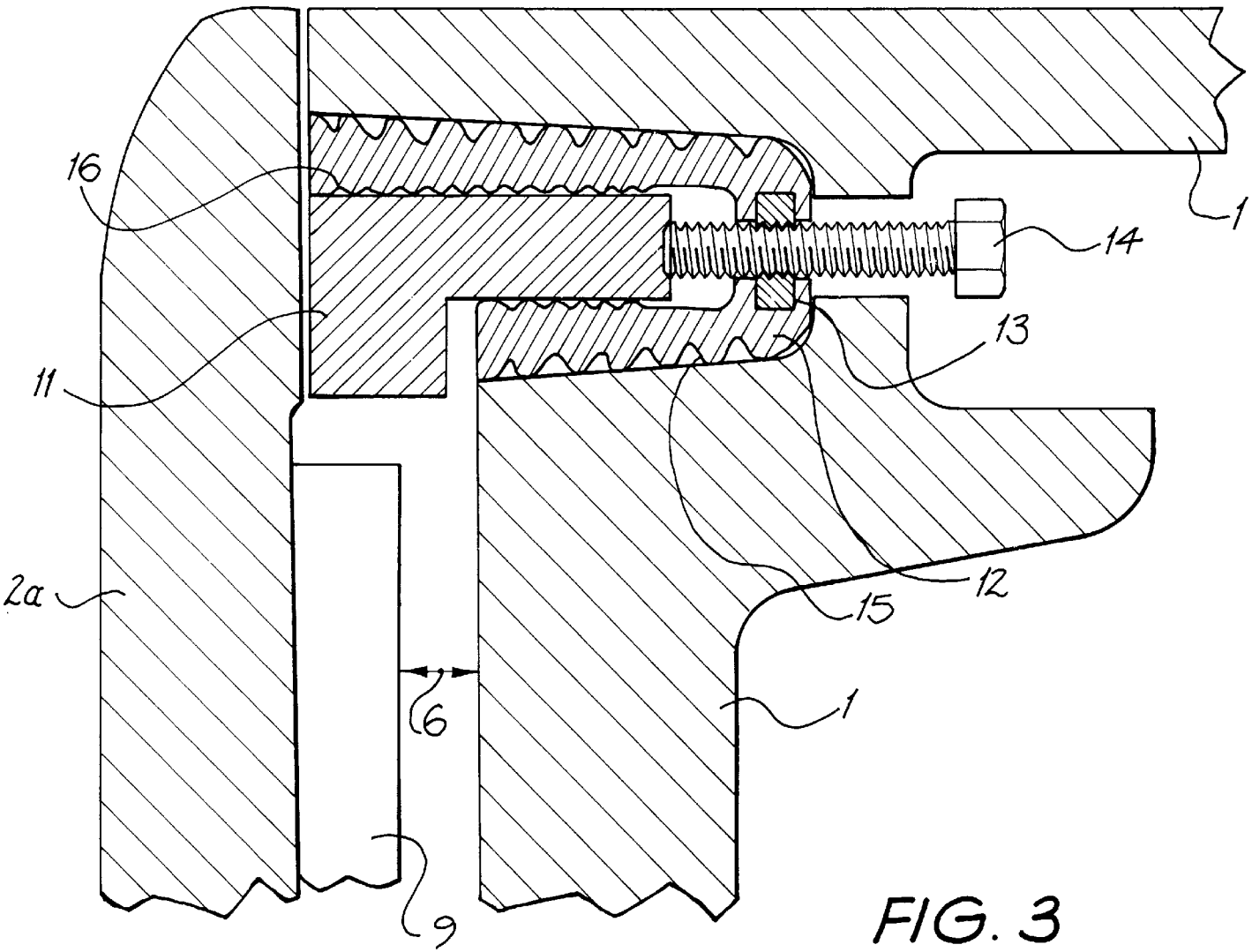
FIG. 3 is a detailed view of a region 'A' of FIG. 2.

Referring now to FIG. 3, the wear ring carrier (12) is provided with lip seals (15) at its outer diameters to retain and seal the carrier (12) within the casing (1). The wear ring (11) is firmly held in the wear ring carrier (12) by ribs (16). The ribs (16) prevent fine particles from entering the clearance between the wear ring (11) and the carrier (12) and preventing axial movement.

The wear ring (11) is axially adjustable (arrows 22) by means of one or more adjustment screws (14). Preferably there are four evenly spaced adjustment screws provided around the circumference of the wear ring carrier (12) for even adjustment. The screws (14) engage a tapped, reinforcing metal insert (13) which is provided in the wear ring carrier (12). When the screws (14) are turned, they push against the wear ring (11) forcing it towards the suction side of the impeller (2*a*). Therefore, the wear ring (11) is adjustable from the exterior of the pump casing, and can be adjusted without stopping the pump.

Because the adjacent faces of the suction side of the impeller (2*a*) and the wear ring (11) are perpendicular to the axis (X—X) of the pump, the wear ring (11) does not have to be concentric with the impeller (2*a* and 2*b*) to perform its sealing function.

Figure 4:
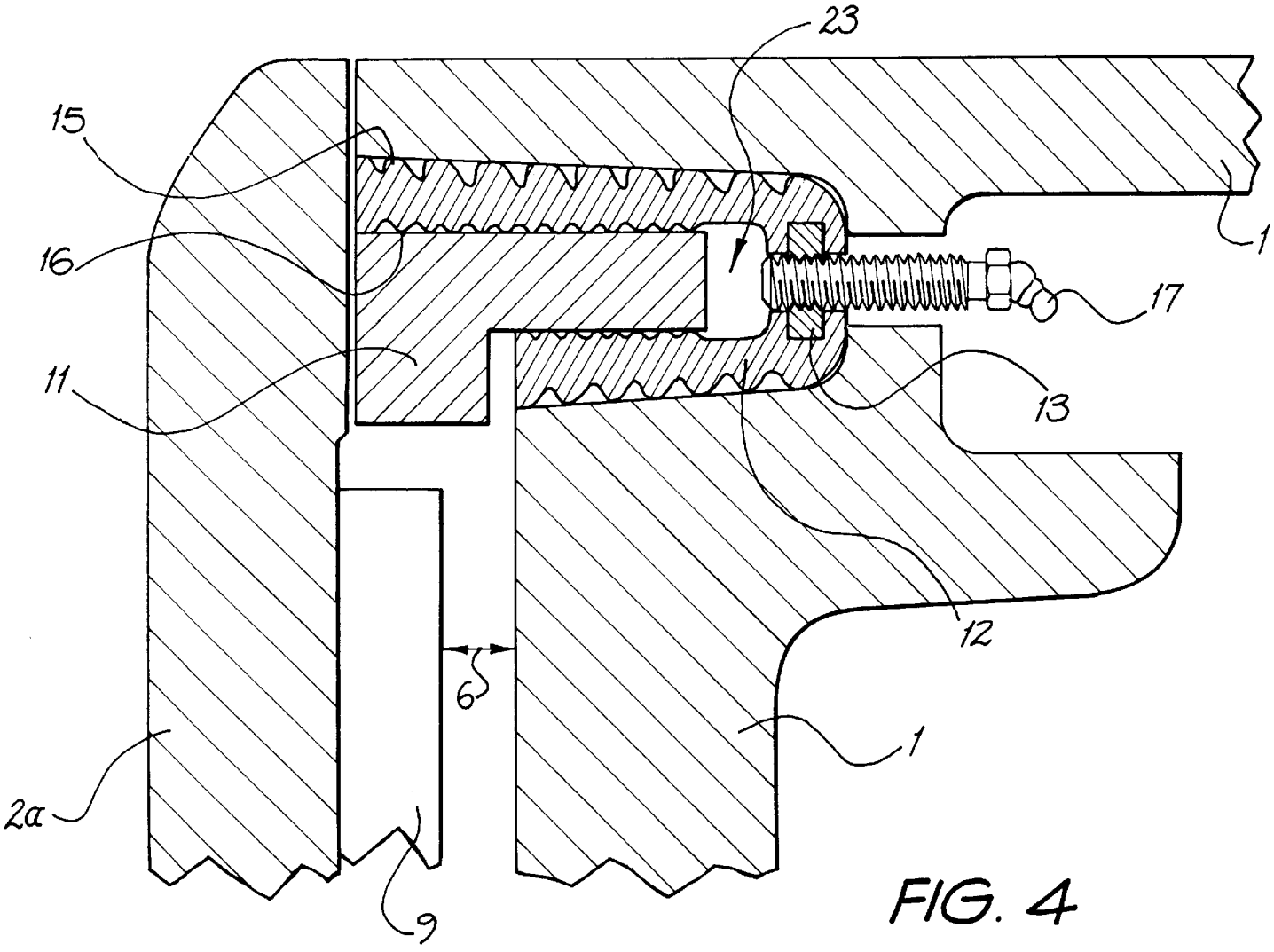
FIG. 4 is a partial cross-section of the centrifugal pump of FIG. 2.

Referring to FIG. 4, the wear ring carrier (12) is also preferably provided with at least one grease nipple (17). Inserting grease behind the wear ring (11), via the grease nipple (17) pressurises the space (23) behind the wear ring (11) and further assists in sealing the wear ring (11) within the carrier (12).

Should degradation of the wear ring carrier (12) occur in particularly high temperature applications, one or more "O" rings (not shown) may be provided as an additional sealing means around the inner and outer circumferences of the wear ring carrier (12). The "O" rings would preferably be housed in additional grooves (not shown) formed in the pump casing (1).

The sealing of the wear ring carrier (12) by the ribs (16) and grease contains the slurry under pressure in the casing (1) and prevents the ingress of ultrafine solids between the carrier (12) and the wear ring (11). This assists with the axial adjustment of the wear ring (11) throughout the working life of the pump. The grease also assists the sliding movement of the wear ring (11).

Figure 5:
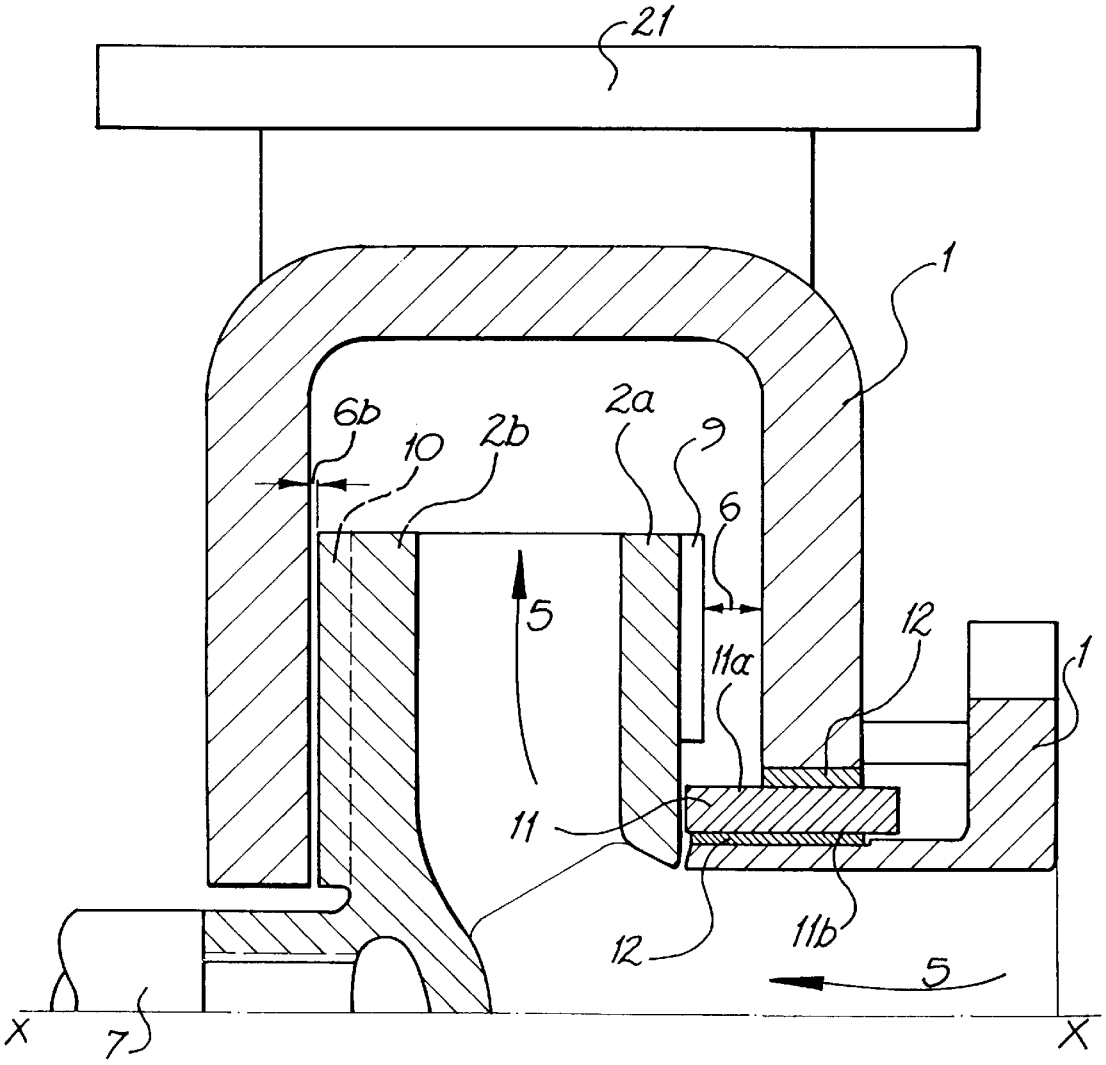
FIG. 5 is a cross-section of another embodiment of a centrifugal pump.

FIG. 5 shows an alternative embodiment of a centrifugal pump. The pump is provided with channels (10) on the gland side (2*b*) of the impeller. As previously described, the channels (10) reduce the amount of open area between the vanes allowing ingress of solids between the impeller (2*b*) and the casing (1), while expelling any as material which may enter the clearance (6).

The pump is also provided with a wear ring (11). The wear ring (11) is sealed and supported in the pump casing (1) by means of a wear ring carrier (12). In the embodiment shown in FIG. 5, the wear ring carrier (12) comprises two resilient annular members located between the inner (11*b*) and the outer (11*a*) diameters of the wear ring (11) and the pump casing (1). The outer diameter (11*a*) of the wear ring (11) is threaded (not shown), and engages threads (not shown) on the wear ring carrier (12). To axially adjust the wear ring (11), the entire wear ring (11) is screwed either towards or away from the impeller (2*a*). "O" rings (not shown) may also be provided for additional sealing.

Alternatively, the wear ring (11) can be axially adjusted by means of a flange (not shown), which is attached to the wear ring (11), and can be bolted (or otherwise attached) to the pump casing (1) at more than one location.

Figure 8:
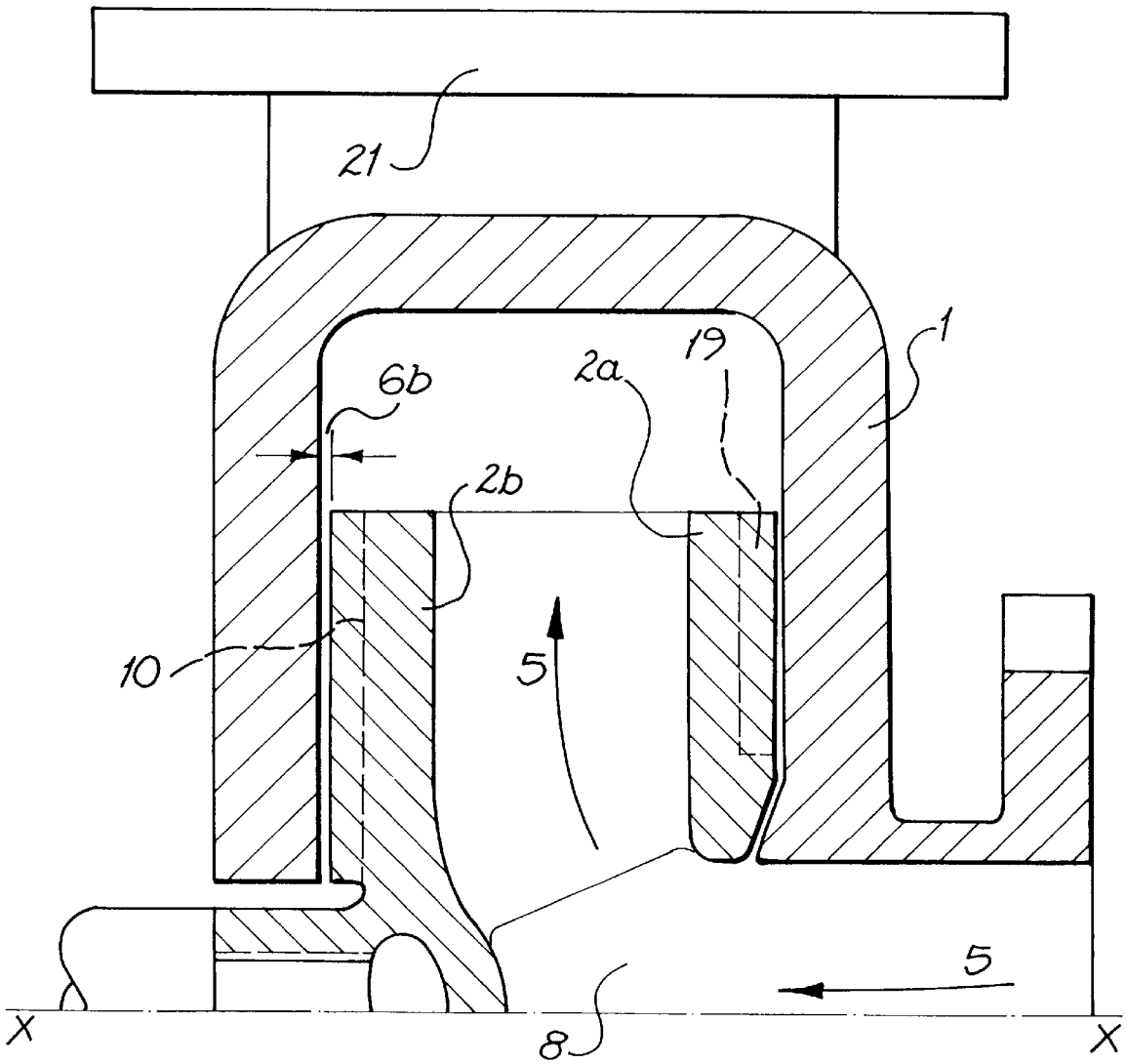
FIG. 8 is a cross-section of another embodiment of a centrifugal pump.

FIG. 8 shows another embodiment of a centrifugal pump which is suitable for use in higher efficiency operations, and for slurries with finer particles, when wear is not such a problem. The pump in FIG. 8 is provided with radial channels (10) and (19) on both the gland (2*b*) and the suction (2*a*) sides of the impeller.

I claim:

1. A centrifugal pump adapted to pump a solid/liquid mixture, comprising:

an impeller rotatable about an axis, said impeller having a suction side and a gland side;

a static volute, said impeller being adapted to rotate inside said static volute:

a plurality of raised vanes on the suction side of said impeller, wherein the clearance between said vanes and said static volute is greater than the predicted size of the largest solid particle in a normal design particle size distribution of said solid/liquid mixture; and axially adjustable sealing means adapted to reduce or substantially eliminate the clearance between the rim at the eye of said impeller and the extended inlet spout of said static volute, wherein said sealing means comprises a substantially annular member at least partially housed within an annular slot or recess in said static volute.

2. The centrifugal pump of claim 1, further comprising a substantially annular carrier housed at least partially within said annular recess or slot in said static volute, said carrier comprising an annular recess facing said impeller, said annular member being at least partially housed in said recess in said carrier.

3. The centrifugal pump of claim 2, further comprising a plurality of threaded adjustment means engaged in corresponding threaded portions in said carrier, said adjustment means adapted to be turned, causing axial movement of said annular member.

4. The centrifugal pump of claim 3, wherein said threaded adjustment means are screws or bolts.

5. The centrifugal pump of claim 2, wherein said carrier is made from polyurethane.

6. The centrifugal pump of claim 2, wherein said carrier comprises a plurality of annular lip seals or ribs around the inner and outer circumferences of said carrier.

7. The centrifugal pump of claim 2, wherein said recess of said carrier comprises a plurality of annular lip seals or ribs.

8. The centrifugal pump of claim 3, wherein said carrier further comprises a rigid reinforcing ring, said reinforcing ring being tapped at predetermined locations to engage said adjustment means.

9. The centrifugal pump of claim 1, further comprising first and second annular carriers housed at least partially within said annular recess or slot in said static volute, said annular member at least partially housed between said first and second carriers.

10. The centrifugal pump of claim 9, wherein a threaded portion of said annular member engages a corresponding threaded portion of said first or second annular carrier, said annular member adapted to be turned within said first and second carriers to effect said axial adjustment.

11. The centrifugal pump of claim 1, further comprising a plurality of radial channels formed in the surface of the gland side of said impeller.

12. The centrifugal pump of claim 1, wherein said static volute is the pump casing.

* * * * *